US011335232B2

(12) United States Patent
Huang et al.

(10) Patent No.: US 11,335,232 B2
(45) Date of Patent: May 17, 2022

(54) DISPLAY DEVICE

(71) Applicant: Innolux Corporation, Miao-Li County (TW)

(72) Inventors: Yu-Chia Huang, Miao-Li County (TW); Kuan-Feng Lee, Miao-Li County (TW); Tsung-Han Tsai, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 0 days.

(21) Appl. No.: 17/184,629

(22) Filed: Feb. 25, 2021

(65) Prior Publication Data

US 2021/0280122 A1 Sep. 9, 2021

(30) Foreign Application Priority Data

Mar. 3, 2020 (CN) ..... 202010140861.5

(51) Int. Cl.
*G09G 3/20* (2006.01)

(52) U.S. Cl.
CPC ... *G09G 3/2007* (2013.01); *G09G 2320/0626* (2013.01)

(58) Field of Classification Search
CPC ... G03G 2215/0414; G03G 2215/0458; G09G 2320/0626
See application file for complete search history.

(56) References Cited

U.S. PATENT DOCUMENTS

| | | | | |
|---|---|---|---|---|
| 2012/0068976 | A1 | 3/2012 | Chang | |
| 2015/0192835 | A1 | 7/2015 | Kim et al. | |
| 2016/0349868 | A1* | 12/2016 | Kim | G06F 1/1637 |
| 2018/0145118 | A1 | 5/2018 | Kim et al. | |
| 2019/0189708 | A1 | 6/2019 | Lee et al. | |

OTHER PUBLICATIONS

"Search Report of Europe Counterpart Application", dated Jul. 9, 2021, p. 1-p. 8.

* cited by examiner

*Primary Examiner* — Priyank J Shah
(74) *Attorney, Agent, or Firm* — JCIPRNET

(57) ABSTRACT

A display device is provided. The display device includes a display unit, a transparency controlling unit, and a driving circuit. The driving circuit is coupled to the display unit and the transparency controlling unit. The driving circuit drives the display unit and the transparency controlling unit in different modes. Therefore, the display device may provide a transparent display function.

10 Claims, 7 Drawing Sheets

DISPLAY DEVICE

CROSS-REFERENCE TO RELATED APPLICATION

This application claims the priority benefit of Chinese patent application serial no. 202010140861.5, filed on Mar. 3, 2020. The entirety of the above-mentioned patent application is hereby incorporated by reference herein and made a part of this specification.

BACKGROUND OF THE INVENTION

1. Field of the Invention

The disclosure relates to a display technology, and in particular, to a transparent display device.

2. Description of Related Art

A transparent display may allow transmission of an ambient light of the background when displaying images, so that the to-be-displayed images and background images may be simultaneously viewed by users.

During actual displaying of image content, if the brightness of the background images is excessively high, the contrast of the image body may be reduced, or feature edges of the image body are easy to be blurred. Therefore, a transparent region corresponding to the image body needs to be properly controlled, to improve the display quality of the images.

SUMMARY OF THE INVENTION

The disclosure provides a transparent display device with different drive modes.

According to an embodiment of the disclosure, the display device includes a display unit, a transparency controlling unit, and a driving circuit. The driving circuit is coupled to the display unit and the transparency controlling unit, where the driving circuit for driving the display unit and the transparency controlling unit in different modes.

Based on the above, the display device of the disclosure can drive the display unit and the transparency controlling unit through different modes, to improve a display effect of the transparent display device.

This disclosure may be understood with reference to the following detailed description and the accompanying drawings. It should be noted that, for ease of understanding by readers and concise drawings, a plurality of drawings in this disclosure merely show a part of an electronic device, and specific components in the drawings are not drawn to scale. In addition, the quantity and size of the components in the drawings are merely exemplary, and are not intended to limit the scope of this disclosure.

BRIEF DESCRIPTION OF THE DRAWINGS

The accompanying drawings are included to provide a further understanding of the disclosure, and are incorporated in and constitute a part of this specification. The accompanying drawings illustrate embodiments of the disclosure and, together with the description, serve to explain the principles of the disclosure.

DESCRIPTION OF THE EMBODIMENTS

Figure 1:
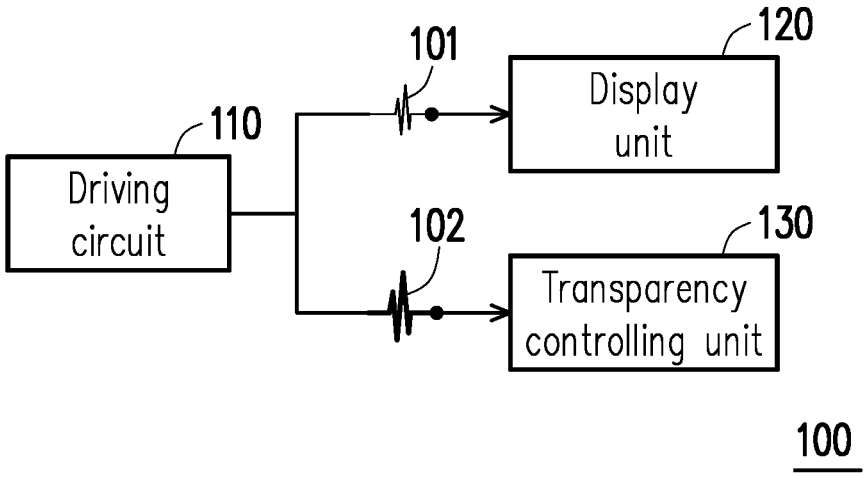
FIG. 1 is a schematic block diagram of a display device according to an embodiment of the disclosure.

Some words are used to refer to specific components in the whole specification and the appended claims in this disclosure. A person skilled in the art should understand that a display device manufacturer may use different names to refer to the same components. This specification is not intended to distinguish components that have the same functions but different names. In this specification and the claims, words such as "include", "comprise", and "have" are open words, and should be interpreted as "including, but not limited to".

The directional terms mentioned herein, like "above", "below", "front", "back", "left", and "right", refer to the directions in the accompanying drawings. Therefore, the directional terms are only used for illustration instead of limiting this disclosure. In the accompanying drawings, common features of a method, a structure and/or a material used in a specific embodiment are shown in the drawings. However, these drawings should not be construed as defining or limiting the scope or nature of these embodiments. For example, the relative sizes, thicknesses and positions of films, regions and/or structures may be reduced or enlarged for clarity.

When a corresponding component such as a film or a region is referred to as being "on another component", it may be directly on the another component, or there may be other components between the two components. In another aspect, when a component is referred to as being "directly on another component", there is no component between the two components. In addition, when a component is referred to as being "on another component", the two components have an up and down relationship in a top view. The component may be located above or below the another component, and the up and down relationship depends on the orientation of the device.

In some embodiments of the disclosure, terms related to junction and connection are, for example, "connect" and "interconnect", and unless specifically defined, may mean that two structures are in direct contact or may mean that two structures are not in direct contact, where other structures are disposed between the two structures. The terms related to junction and connection may include a situation in which two structures are movable or two structures are fixed. In addition, the term "couple" includes any direct and indirect electrical connection manner.

Ordinal numbers used in this specification and the claims, like "first" and "second", are used to modify the components, and do not imply or represent that the (or these) component (or components) has (or have) any ordinal number, and do not indicate any order between a component and another component, or an order in a manufacturing method. These ordinal numbers are merely used to clearly distinguish a component having a name with another component having the same name. Different terms may be used in the claims and the specification, so that a first component in the specification may be a second component in the claims.

It should be noted that, in the following embodiments, the technical features in several different embodiments may be replaced, recombined, and mixed to complete other embodiments without departing from the spirit of the disclosure.

FIG. 1 is a schematic block diagram of a display device according to an embodiment of the disclosure. Referring to FIG. 1, the display device 100 includes a driving circuit 110, a display unit 120, and a transparency controlling unit 130. The driving circuit 110 is coupled to the display unit 120 and the transparency controlling unit 130. In the present embodiment, the display unit 120 may include, for example, a liquid crystal, an organic light emitting diode (OLED), an inorganic light emitting diode (ILED), a mini-LED, a micro-LED, quantum dots (QDs), a quantum dot diode (QLED/QDLED), an electro-phoresis, fluorescence, phosphor, other suitable materials or a combination of the above materials, but the disclosure is not limited thereto. The transparency controlling unit 130 may include, for example, materials such as dichroic dye liquid crystal (DDLC), polymer dispersed liquid crystal (PDLC), polymer network liquid crystal (PNLC), cholesteric liquid crystal (CLC), electrochromic (EC), Suspended Particle Device (SPD) or a liquid crystal, but the disclosure is not limited thereto.

In the present embodiment, the driving circuit 110 for the display unit 120 and the transparency controlling unit 130 in different modes. The "different modes" refer to, for example, providing different signals, where the signals may include, for example, a voltage signal, a current signal, a gray level, or a refresh rate, but is not limited thereto. For example, the driving circuit 110 provides a driving signal 101 to the display unit 120 and the driving circuit 110 provides a driving signal 102 to the transparency controlling unit 130, to drive the display unit 120 and the transparency controlling unit 130. The driving signal 101 is different from the driving signal 102. In other words, a type of a pixel unit of the display unit 120 is different from that of the transparency controlling unit 130. Therefore, the display unit 120 and the transparency controlling unit 130 are driven in different driving signals. For example, if the display unit 120 is a pixel unit including an OLED, and the transparency controlling unit 130 is a pixel unit including a liquid crystal, the display unit 120 is driven in a current mode, and the transparency controlling unit 130 is driven in a voltage mode. In other words, the driving signal 101 provided by the driving circuit 110 to the display unit 120 is a current signal, and the driving signal 102 provided to the transparency controlling unit 130 is a voltage signal, but the disclosure is not limited thereto.

In some embodiments, the driving signal 101 and the driving signal 102 may be signals with different number of gray levels. For example, because the display unit 120 is configured to display an image, the driving signal 101 may provide a first number of gray levels to the display unit 120. For example, the first number is 256. Therefore, the display unit 120 may have 256 levels of gray levels, to display a finer image picture. Since the transparency controlling unit 130 is configured to present a transparent or non-transparent visual effect, the driving signal 102 may provide a second number of gray levels to the transparency controlling unit 130. For example, the second number of gray levels is 2. Therefore, the transparency controlling unit 130 may have 2 levels of gray levels, to represent a transparent or non-transparent state. The transparent state may be, for example, that a viewer can see a scene or an object of the other side of the display device 100 through the transparency controlling unit 130 from one side of the display device 100. The non-transparent state may be, for example, that the viewer cannot see a scene or an object of the other side of the display device 100 through the transparency controlling unit 130 from one side of the display device 100, or the viewer cannot clearly see a scene or an object of the other side of the display device 100 through the transparency controlling unit 130 from one side of the display device 100. Specifically, the display device 100 may include a plurality of display units 120 and a plurality of transparency controlling units 130. The display device 100 may drive some display units 120 to display image, and the non-transparent display effect on positions of the display units 120 that display the image pictures may be provided by some transparency controlling units 130, and use the other transparency controlling units 130 to provide a transparent display effect on positions that the other display units 120 do not display the image pictures. Therefore, the display device 100 of the present embodiment may provide a transparent display effect with a high contrast. In some other embodiments, the positions of the display units 120 that display the image pictures may also provide a transparent display effect by using some transparency controlling units 130. Therefore, the viewer may simultaneously view the image pictures and objects through the display device.

However, the driving signal 101 and the driving signal 102 of the disclosure are not limited to the number of gray levels. In other embodiments, the driving signal 101 may include more than or less than 256 levels of gray levels, and the driving signal 102 may include more than 2 levels of gray levels, but are not limited thereto. Therefore, in an embodiment, the display unit 120 may be driven in the first number of gray levels, and the transparency controlling unit 130 may be driven in the second number of gray levels, where the first number is different from the second number. In some embodiments, the first number is greater than the second number. In addition, in another embodiment, the display unit 120 and the transparency controlling unit 130 may also be driven in different refresh rates respectively. For example, the display unit 120 may be driven in a higher refresh rate, for example, 240 Hz, to provide a good display effect. Moreover, compared with the display unit 120, because the transparency controlling unit 130 is mainly configured to present a transparent or non-transparent visual effect, the transparency controlling unit 130 may be driven in a lower refresh rate, for example, 1 Hz, so as to achieve a power-saving effect and effectively provide a good transparent or non-transparent visual effect, but the disclosure is not limited thereto.

In some embodiments, a drive time sequence between the display unit 120 and the transparency controlling unit 130 may correspond to each other. For example, an enabling time of the display unit 120 may be the same as that of the transparency controlling unit 130, or the display unit 120 and the transparency controlling unit 130 may be enabled at a roughly same time point.

Figure 2:
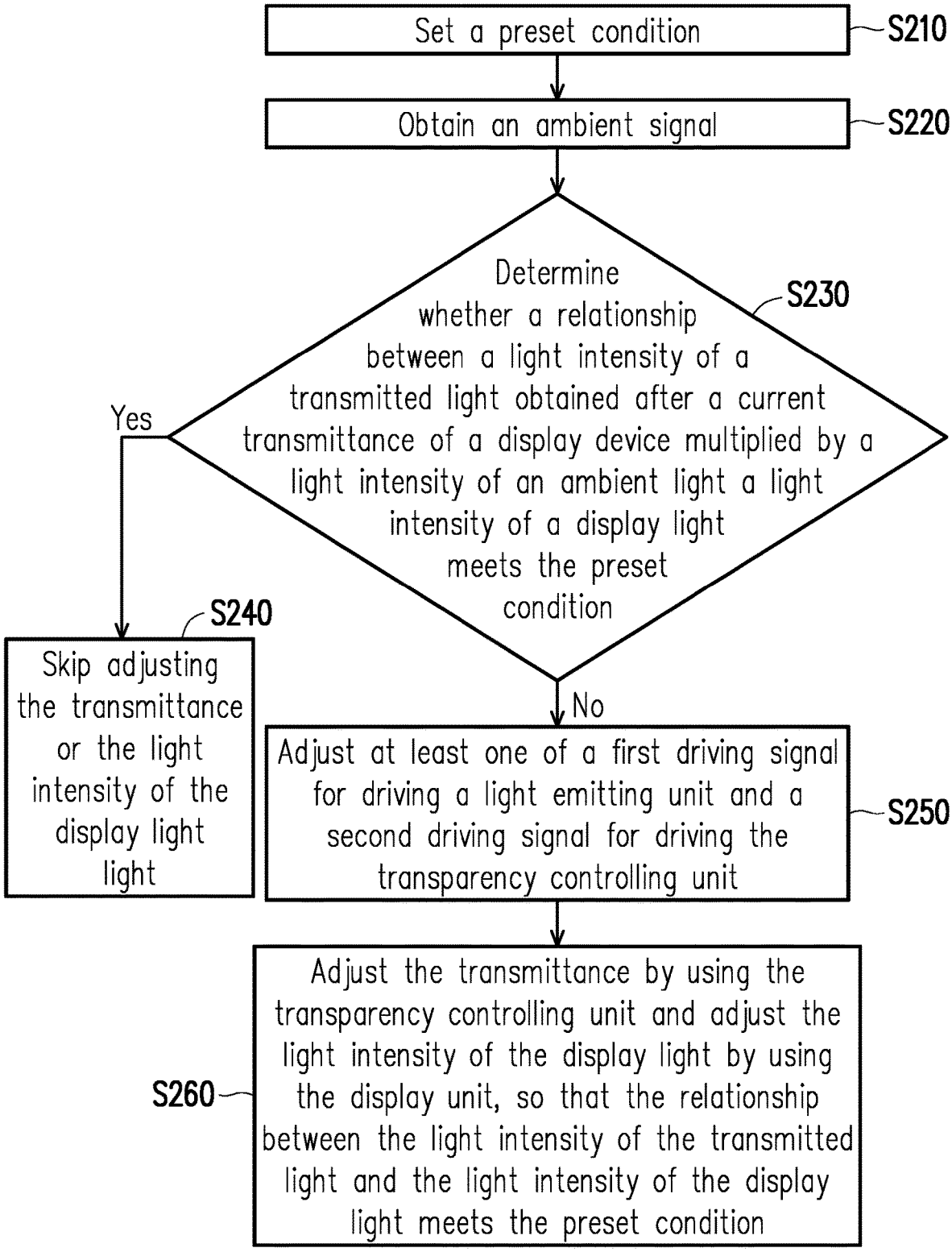
FIG. 2 is a flowchart of a drive method of the display device according to an embodiment of the disclosure.

FIG. 2 is a flowchart of a drive method of the display device according to an embodiment of the disclosure. Referring to FIG. 1 and FIG. 2, the display device 100 of FIG. 1 may perform steps S210 to S260. It should be first noted that, the display device 100 of FIG. 1 may further include an ambient light sensing unit, to sense a light intensity of an ambient light in real time, where the ambient light sensing unit may be configured outside or inside the display device 100, which is not limited in the disclosure. Moreover, the display device 100 may correspondingly adjust a light intensity or a transmittance of a display light of a display panel according to variation of intensity of the ambient light, so that the display device 100 may maintain a good display effect. In the disclosure, the "light intensity" refers to a spectrum integral value of a light source (for example, the display light or the ambient light). In some embodiments, the light source may include a visible light (for example, the wavelength ranges from 380 nm to 780 nm) or an ultraviolet light (for example, the wavelength is less than 365 nm), but is not limited thereto. That is, when the light source is a visible light, the light intensity is a spectrum integral value within a range of the wavelength 380 nm to the wavelength 780 nm. The transmittance of the disclosure refers to the percentage of a light intensity of a transmitted light measured after the ambient light passes through the display device 100 being divided by a light intensity measured when the ambient light does not pass through the display device 100.

Based on the above condition, the display device 100 may include the following steps S210 to S260. In step S210, a user may set a preset condition in the display device 100, where the preset condition may be, for example, a specific proportional relationship between the light intensity of the display light of the display device 100 and the light intensity of the transmitted light, and is described in detail in the following embodiment of the FIG. 3. In step S220, the ambient light sensing unit of the display device 100 may obtain an ambient signal, for example, a light intensity of an ambient light. In step S230, the driving circuit 110 determines whether a relationship between a light intensity of a current transmitted light of the display device 100 and a light intensity of a display light meets the preset condition. If the relationship meets the preset condition, in step S240, the driving circuit 110 does not adjust the transmittance or the light intensity of the display light. If the relationship does not meet the preset condition, in step S250, the driving circuit 110 adjusts at least one of the driving signal 101 for driving the display unit 120 and the driving signal 102 for driving the transparency controlling unit 130. In step S260, the display device 100 may adjust the transmittance using the transparency controlling unit 130 and adjust the light intensity of the display light using the display unit 120, so that the relationship between the light intensity of the transmitted light and the light intensity of the display light meets the preset condition.

The above "light intensity of the display light" may be designed and adjusted according to requirements of the designer. For example, different driving signals may be designed on a driving chip or the driving circuit to correspond to light intensities of different display lights. For example, if the display device 100 needs a light intensity of a 100-nit display light, the driving chip or the driving circuit may provide a corresponding driving signal to make the display device 100 have the light intensity of the 100-nit display light. The above "light intensity of the transmitted light" may also be designed and adjusted according to requirements of the designer. For example, different driving signals may be designed on the driving chip or the driving circuit to correspond to light intensities of different transmitted lights, where the driving signal may also correspond to the transmittance.

Therefore, the display device 100 of the present embodiment may provide an automatic adjustment function of at least one of the display unit 120 and the transparency controlling unit 130 according to the light intensity of the ambient light and the relationship between the light intensity of the current display light and the light intensity of the transmitted light, so that the display device 100 may automatically maintain a good display effect under changes of different ambient lights. In addition, in an embodiment, the display device 100 of FIG. 1 may further include an input interface (not shown) and a control unit (not shown), for a user to input a control instruction through the input interface to manually control the control unit to adjust at least one of the light intensity of the display light of the display device 100 (for example, the light intensity of the display light of the display unit 120) or the transmittance according to the control instruction. In other words, the contrast of the image pictures displayed by the display device 100 may also be manually set according to a user preference or a use requirement.

Figure 3:
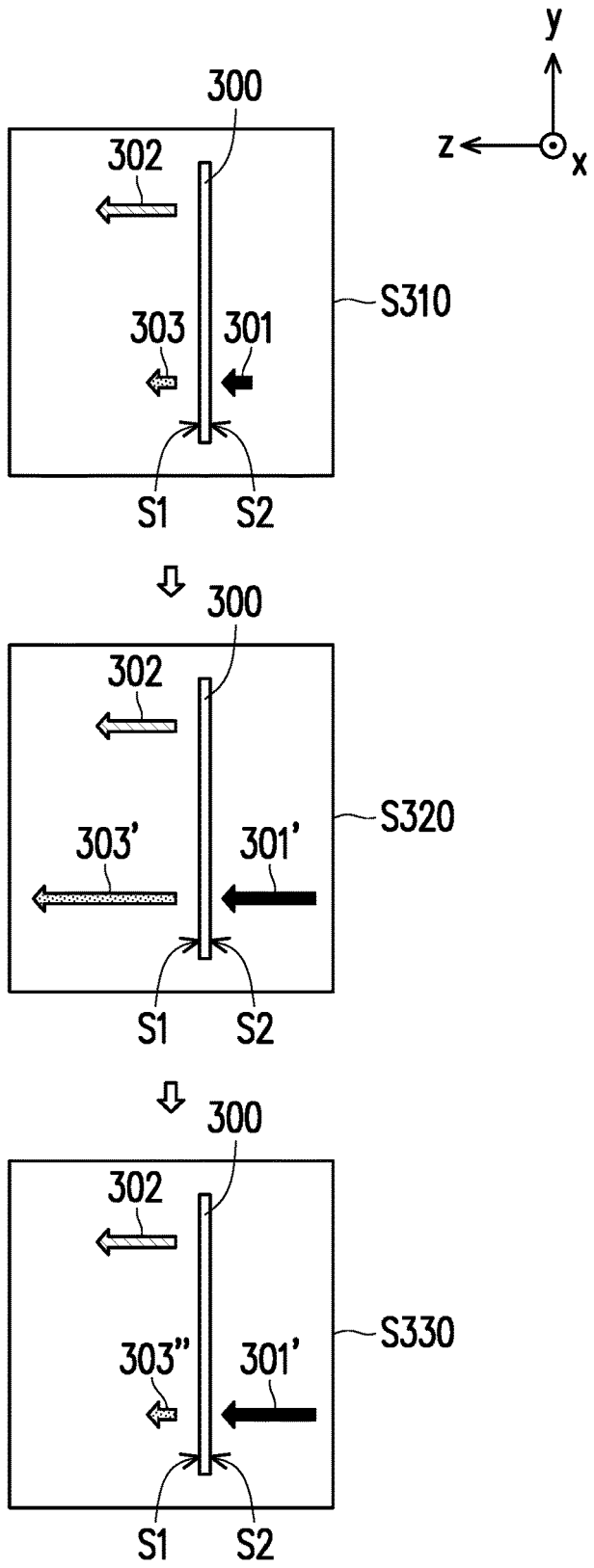
FIG. 3 is a schematic side view of adjusting a transmittance or a light intensity of a display light according to an embodiment of the disclosure.

FIG. 3 is a schematic side view of adjusting a transmittance or a light intensity of a display light according to an embodiment of the disclosure. Referring to FIG. 3, the automatic adjustment manner of the above embodiment of FIG. 2 may continue to be used. Situations S310 to S320 of FIG. 3 are used for exemplarily describe how the display device 100 of the disclosure maintains the display effect of the display device 100 by adjusting the transmittance or the light intensity of the display light, where the preset condition may be, for example, a light intensity of a display light 302 is greater than or equal to twice a light intensity of a transmitted light 303, but the disclosure is not limited thereto. It should be noted that, a direction x, a direction y, and a direction z are marked in FIG. 3. The direction z may be, for example, a direction of the display device 100 facing a viewer. The direction z may be perpendicular to the direction x and the direction y, and the direction x may be perpendicular to the direction y. The subsequent figures may describe the following embodiments according to the direction x, the direction y, and the direction x. Therefore, in the situation S310, the display device 300, for example, emits a 200-nit display light 302. A back side S2 of the display device 300 may, for example, receive a 100-nit ambient light 301, and the display device 300 may, for example, have a transparent display effect of a 50% transmittance. Therefore, a display side S1 of the display device 300 may emit a 50-nit transmitted light 303, and the relationship between the light intensity of the transmitted light of the display device 300 and the light intensity of the display light meets the preset condition ($200 \geq 2 \times 50$). In some other embodiments, the viewer may view a display image from the display side S1 or the back side S2 of the display device 300, but the disclosure is not limited thereto.

Incidentally, in a measurement situation, the display device 300 of the present embodiment displays a fixed picture. Therefore, in an environment of a known light intensity of an ambient light, a fixed display region of the display device 300 may be measured to obtain a sum of the light intensity of the transmitted light and the light intensity of the display light. Next, in an environment in which the ambient light is completely shielded, the same fixed display region of the display device 300 may be separately measured to obtain the light intensity of the display light. Therefore, after the above two measurement results are subtracted, the light intensity of the transmitted light may be obtained, and the relationship between the light intensity of the transmitted light of the display device 300 and the light intensity of the display light may be obtained by adjusting the light intensity of the ambient light and according to the above measurement manner, to further speculate whether the relationship meets the preset condition. In addition, in the environment of the known light intensity of the ambient light, a display unit and a transparent control unit in the fixed display region of the display device 300 may also be respectively measured separately, to simultaneously obtain the light intensity of the transmitted light and the light intensity of the display light, and also obtain the relationship between the light intensity of the transmitted light of the display device 300 and the light intensity of the display light.

Referring to FIG. 3, when the brightness of the environment changes, in the situation S320, if the display device 300, for example, emits a 200-nit display light 302, the back side S2 of the display device 300 may, for example, change to receiving a 1000-nit ambient light 301'. Therefore, if the display device 300 maintains the transparent display effect of the 50% transmittance, the display side S1 of the display device 300 emits a 500-nit transmitted light 303', the relationship between the light intensity of the transmitted light of the display device 300 and the light intensity of the display light does not meet the preset condition ($200<2\times500$), and the display effect of the display device 300 is affected by the excessively high brightness of the ambient light, causing a poor contrast of the image pictures displayed by the display device 300. Therefore, in the situation S330, the display device 300 may perform the above procedure of FIG. 2, to automatically lower the transmittance of the display device 300 to 10%. Therefore, the display side S1 of the display device 300 whose transmittance has been automatically adjusted may emit a 100-nit transmitted light 303". Accordingly, the relationship between the light intensity of the transmitted light of the display device 300 whose transmittance has been automatically adjusted and the light intensity of the display light may meet the preset condition ($200\geq2\times100$).

In addition, in an embodiment, the display device 300 may also raise the light intensity of the display light of the display device 300 in the situation S330 to make the relationship between the light intensity of the transmitted light of the display device 300 whose transmittance has been automatically adjusted and the light intensity of the display light meet the preset condition. Alternatively, the manner of synchronously raising the light intensity of the display light and lowering the transmittance may be used to make the relationship between the light intensity of the transmitted light of the display device 300 whose transmittance has been automatically adjusted and the light intensity of the display light meet the preset condition, which is not limited to the above manner for adjusting the transmittance or adjusting the light intensity of the display light. In some other embodiments, if the brightness of the ambient light is excessively high, even if the display device 300 automatically lowers the transmittance to a lowest transmittance and/or automatically raises the display light to a highest light intensity, the relationship between the light intensity of the transmitted light of the display device 300 whose transmittance and/or light intensity of the display light have/has been automatically adjusted may cannot meet the preset condition, but the display device 300 still automatically lowers the transmittance to the lowest transmittance and/or automatically raises the display light to the highest light intensity, to achieve a good transparent display effect.

In other words, under changes of different intensities of ambient lights, if a display device has an implementation manner, as in the embodiment of FIG. 1, in which the driving circuit 110 may drive the display unit 120 and/or the transparency controlling unit 130 in different drive modes, to adjust the light intensity of the display light or the transmittance of the display panel in FIG. 2 or FIG. 3, the relationship between the light intensity of the transmitted light and the light intensity of the display light that is obtained by the display device according to the above measurement method may meet the preset condition in FIG. 2 or FIG. 3.

Figure 4:
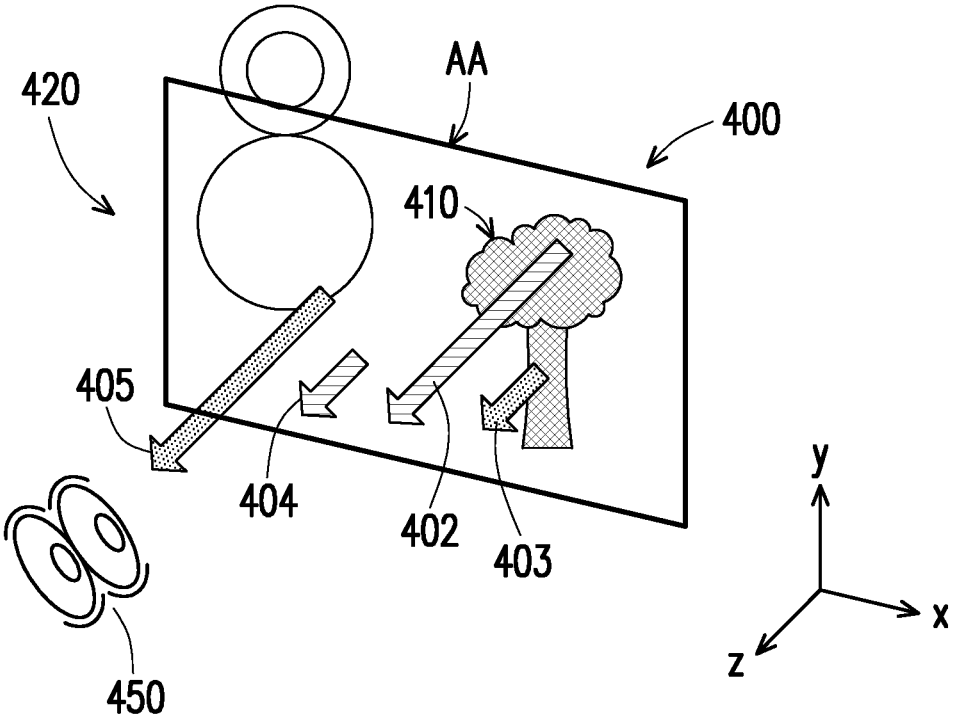
FIG. 4 is a schematic diagram of the display device in mixed display according to an embodiment of the disclosure.

FIG. 4 is a schematic diagram of the display device in mixed display according to an embodiment of the disclosure. Referring to FIG. 4, the display device 400 may also include the related internal units of the display device 100 in FIG. 1, which are therefore not described again. In the present embodiment, the display device 400 may implement a transparent display effect of being partially transparent and partially displayed. As shown in FIG. 4, a part of a display region AA of the display device 400 may be used for displaying image picture content 410, and a part outside the image picture content 410 may be presented as a transparent state (for example, a transmittance of the display region AA outside the image picture content 410 is higher), so that a background image light of a background image 420 behind the display device 400 may pass through the display device 400. In other words, a viewer 450 may simultaneously view the image picture content 410 and the background image 420 behind the display device 400 clearly from the display device 400 of the present embodiment.

In the present embodiment, the display device 400 may adjust transmittances of different display regions of the display device 400 and the light intensity of the display light according to different requirements. For example, the part of the display region AA of the display device 400 corresponding to the image content 410 may be a display mode. The display mode means that the light intensity of the display light 402 of the display device 400 of the part of the display region AA displaying the image content 410 is greater than the light intensity of the transmitted light 403 (namely, the transmittance of the part of the display block AA displaying the image content 410 is lower), so that the image content 410 may be clearly displayed. In an embodiment, the light intensity of the transmitted light 403 of the display device 400 operated in the display mode divided by the light intensity of the display light 402 may be, for example, less than 1 or less than 0.5. However, the other part of the display region AA of the display device 400 corresponding to the background image 420 behind the display device 400 may be in a transparent mode. The transparent mode means that the light intensity of the transmitted light 405 of the other part of the display region AA of the display device 400 may be greater than the light intensity of the display light 404 (namely, the transmittance of the other part of the display block AA displaying the image content 410 is higher), so that the background image light of the background image 420 behind the display device 400 may pass through the display device 400 to be clearly displayed. In an embodiment, the light intensity of the transmitted light 405 of the display device 400 operated in the transparent mode divided by the light intensity of the display light 404 may be, for example, greater than 1 or greater than 2. In other words, different display regions of the display device 400 of the present embodiment may drive the display unit and the transparency controlling unit in different modes according to specific display requirements, for example, provide different driving signals 101 to drive the display unit and provides different driving signals 102 to drive the transparency controlling unit, so that the display device 400 may have both the display mode and the transparent mode, to provide a good transparent display effect.

Figure 5A:
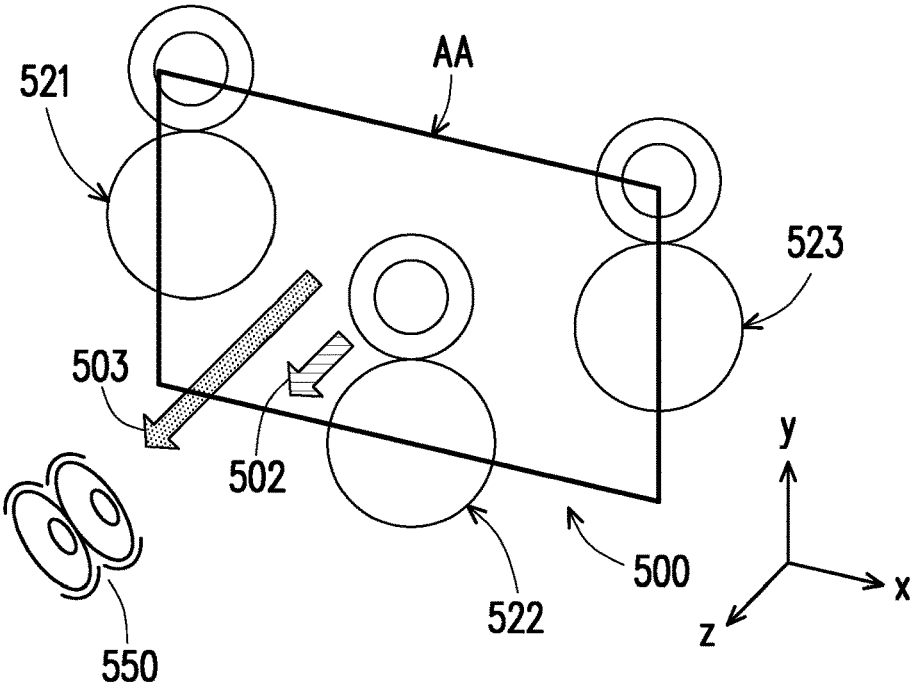
FIG. 5A is a schematic diagram of the display device in a display mode according to an embodiment of the disclosure.
Figure 5B:
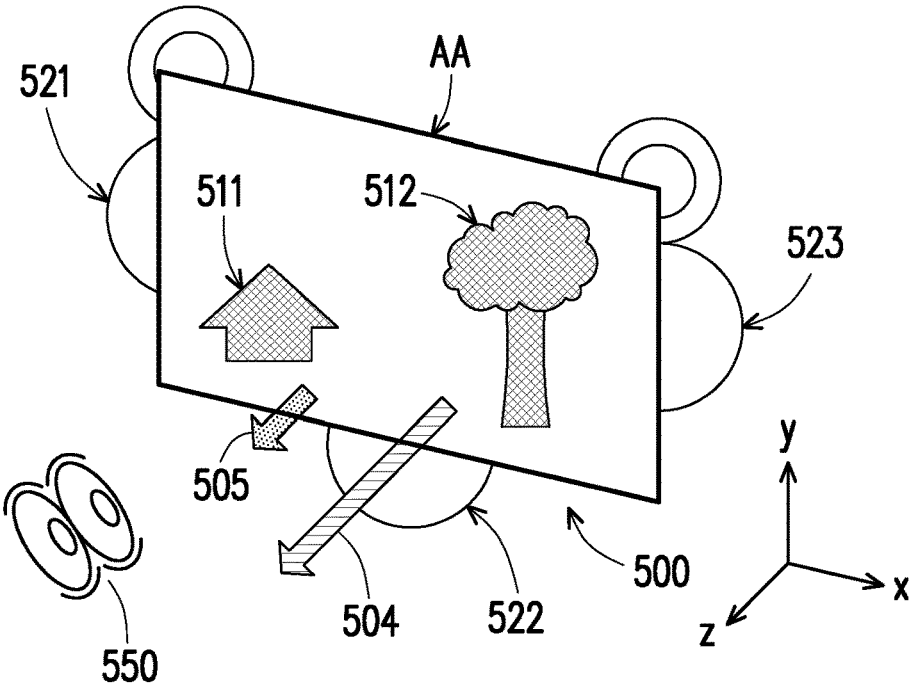
FIG. 5B is a schematic diagram of the display device in a transparent mode according to an embodiment of the disclosure.

FIG. 5A is a schematic diagram of the display device in a transparent mode according to an embodiment of the disclosure. FIG. 5B is a schematic diagram of the display device in a display mode according to an embodiment of the disclosure. The display device 500 in FIG. 5A and FIG. 5B may also include the related internal units of the display device 100 in FIG. 1, and are therefore not described again. Referring to FIG. 5A first, if the current display requirement of the display device 500 is to be presented on the entire images 521, 522, and 523 behind the display device 500, the entire display region AA of the display device 500 may be in a transparent mode. The transparent mode means that the light intensity of the transmitted light 503 of the entire display region AA of the display device 500 may be far greater than the light intensity of the display light 502, so that the images 521, 522, and 523 behind the display device 500 may pass through the display device 500 to be clearly viewed by the viewer 550 in front of the display device 500. Comparatively, referring to FIG. 5B next, if the current display requirement of the display device 500 is to shield the images 521, 522, and 523 behind the display device 500, namely, the images 521, 522, and 523 behind the display device 500 cannot be viewed by the viewer. All image content 511 and 512 are further displayed, namely, the entire display region AA of the display device 500 may be in a display mode. Therefore, the light intensity of the transmitted light 505 of the entire display region AA of the display device 500 may be far less than the light intensity of the display light 504, so that the viewer 550 in front of the display device 500 may clearly view all the image content 511 and 512 displayed by the display device 500.

Figure 6A:
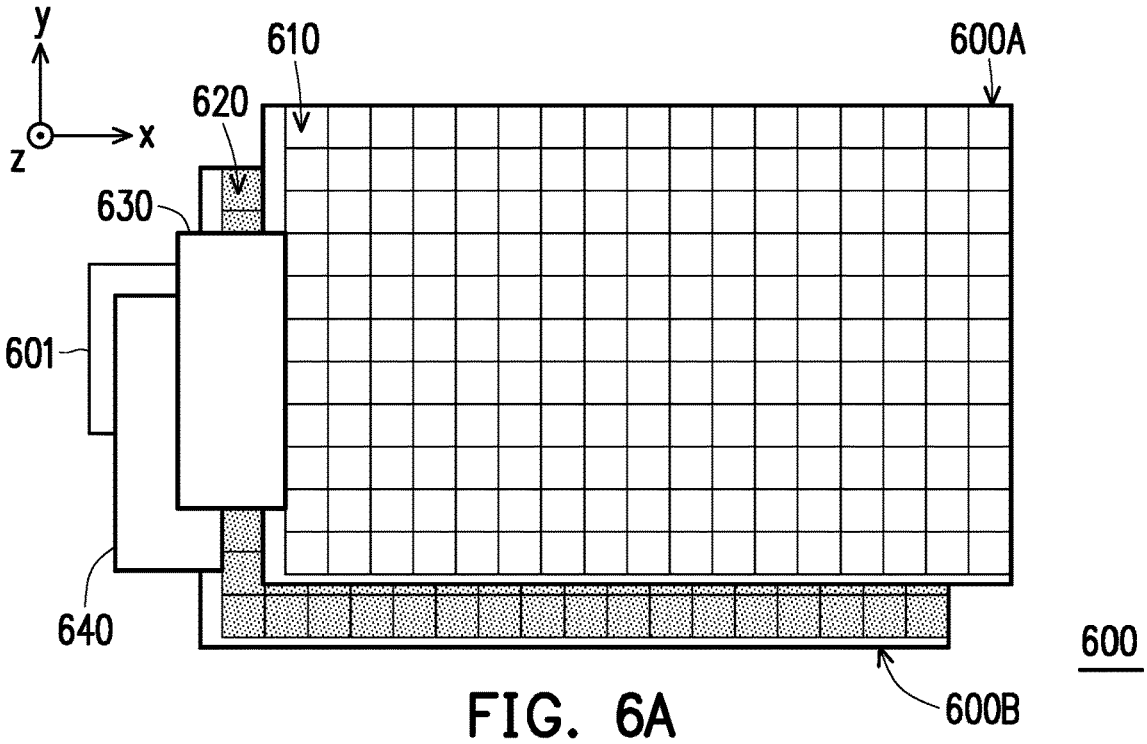
FIG. 6A is a schematic top view of a panel structure of the display device according to an embodiment of the disclosure.
Figure 6B:
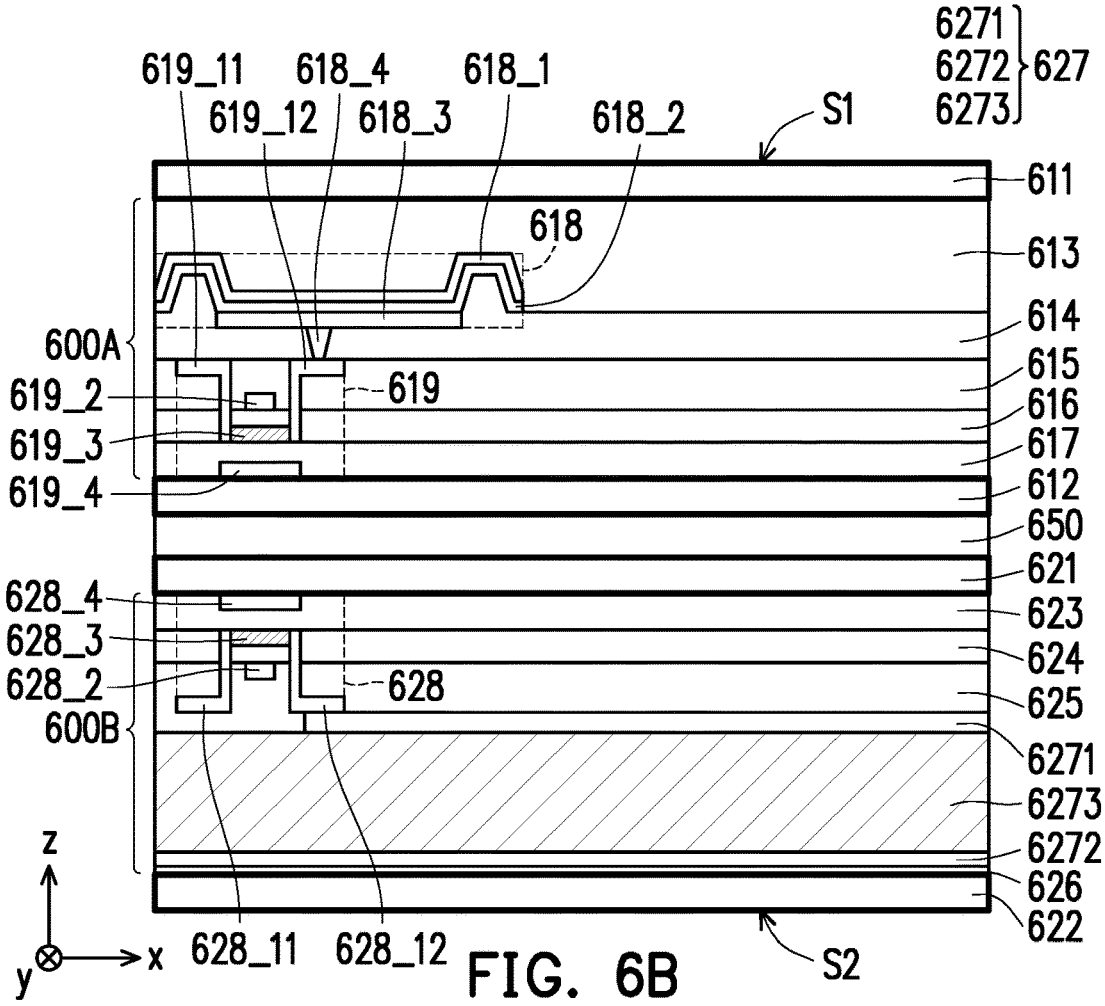
FIG. 6B is a schematic cross-sectional view of configurations of a display unit and a transparency controlling unit according to the embodiment of FIG. 6A of the disclosure.

FIG. 6A is a schematic top view of a panel structure of the display device according to an embodiment of the disclosure. FIG. 6B is a schematic cross-sectional view of a display unit and a transparency controlling unit according to the embodiment of FIG. 6A of the disclosure. Referring to FIG. 6A first, the display device 600 may be, for example, an on-cell panel structure. The display device 600 includes display panels 600A and 600B and driving circuits 630 and 640, where the display panel 600A is stacked above the display panel 600B. For example, observing from the direction z, the display panel 600A and the display panel 600B are at least partially overlapped. In the present embodiment, the display panel 600A includes a plurality of display units 610 arranged in an array, and the display panel 600B includes a plurality of transparency controlling units 620 arranged in an array. The display panels 600A and 600B are respectively driven by different driving signals provided by the driving circuits 630 and 640, and the driving circuit 630 and the driving circuit 640 may be coupled through a wire 601, so that the driving circuits 630 and 640 may be controlled and may synchronously or respectively provide the driving signal 101 and the driving signal 102, to implement the display effects of the above embodiments. Specifically, the display device 600 may provide the driving signal 102 using the driving circuit 640 to control the transparency controlling unit 620, to determine a transmittance of the display device 600, namely, determine a transparent display degree of an image picture. In some embodiments, the driving circuit 630 and the driving circuit 640 may be regarded as a same driving circuit, but are not limited thereto.

Referring to FIG. 6B next, the cross-sectional structures of the display panels 600A and 600B are shown in FIG. 6B. FIG. 6B shows a schematic cross-sectional view of one transparency controlling unit corresponding to one display unit. One display unit 610 of the display panel 600A may be correspondingly disposed on one transparency controlling unit 620 of the display panel 600B. In other words, in the direction z, one display unit 610 may be at least partially overlapped with one transparency controlling unit 620. In the present embodiment, an upper substrate 611 of the display panel 600A is close to a display side S1 of the display device 600, and a lower substrate 622 of the display panel 600B is away from a display side S1 of the display device 600. In the present embodiment, for example, an encapsulating layer 613, a planarization layer 614, a passivation layer 615, a gate insulating layer 616, and an interval layer 617 may be disposed between the upper substrate 611 and the lower substrate 612 of the display panel 600A. It should be noted that, the encapsulating layer 613, the planarization layer 614, the passivation layer 615, the gate insulating layer 616, and the interval layer 617 of the present embodiment may be, for example, an insulating layer. The insulating layer may also be a single layer or another multilayer structure in some embodiments, and may include, for example, an organic material, an inorganic material, or a combination of the above, which is not limited in FIG. 6B.

In the present embodiment, the display unit 610 includes a display part 618 and a controlling transistor 619. The display part 618 of the display unit 610 is disposed between the encapsulating layer 613 and the planarization layer 614, and the controlling transistor 619 of the display unit 610 is disposed among the passivation layer 615, the gate insulating layer 616, and the interval layer 617. The display part 618 may be, for example, an OLED, and include a part of an upper electrode 618_1, a light emitting layer 618_2, and a lower electrode 618_3. The controlling transistor 619 may be, for example, a thin-film transistor (TFT), and includes a source 619_11, a drain 619_12, a gate 619_2, a semiconductor layer 619_3, and a light shield layer 619_4. The light shield layer 619_4 may be, for example, a metal material or another light shield material. In some embodiments, the controlling transistor 619 may also not be provided with the light shield layer 619_4. The display part 618 is electrically connected to the controlling transistor 619 through a via hole 618_4. It should be noted that, the controlling transistor 619 of the present embodiment is a top gate structure, but the disclosure is not limited thereto. In an embodiment, the controlling transistor 619 may also be a bottom gate structure. In the present embodiment, the controlling transistor 619 is configured to drive the display part 618 according to the driving signal provided by the driving circuit 630. Therefore, the controlling transistor 619 may control the display part 618 to generate the display light or disable the display part 618.

In the present embodiment, an adhesive layer 650 is provided between the lower substrate 612 of the display panel 600A and the upper substrate 621 of the display panel 600B. The adhesive layer 650 may include, for example, optical clear adhesive (OCA) or optical clear resin (OCR), and the disclosure is not limited thereto. An interval layer 623, an interval layer 626, a gate insulating layer 624, and a passivation layer 625 are disposed between the upper substrate 621 and the lower substrate 622 of the display panel 600B. It should be noted that, the interval layer 623, the interval layer 626, the gate insulating layer 624, and the passivation layer 625 of the present embodiment may be, for example, an insulating layer. The insulating layer may be single layer or another multilayer structure in some embodiments, and includes an organic material, an inorganic material, or a combination of the above, but is not limited in FIG. 6B.

In the present embodiment, any transparency controlling unit 620 in the display panel 600B may include a transparent part 627 and a controlling transistor 628. The controlling transistor 628 of the transparency controlling unit 620 is disposed among the interval layer 623, the gate insulating layer 624, and the passivation layer 625, and the transparent part 627 of the transparency controlling unit 620 is disposed between the passivation layer 625 and the interval layer 626. The transparent part 627 may include an electrode layer 6271, a part of a common electrode layer 6272, and a part of a medium layer 6273. The medium layer 6273 may include, for example, a liquid crystal material, but is not limited thereto. In addition, electrode layers of different transparency controlling units may be separated from each other, but may be formed according to a same process. The controlling transistor 628 may be, for example, a TFT, and includes a source 628_11, a drain 628_12, a gate 628_2, a semiconductor layer 628_3, and a light shield layer 628_4. The drain 628_1 of the controlling transistor 628 is electrically connected to the electrode layer 6271 of the transparent part 627. In the present embodiment, the controlling transistor 628 is configured to drive the medium layer 6273 through the electrode layer 6271 and the common electrode layer 6272 according to the driving signal provided by the driving circuit 640. That is, the controlling transistor 628 may control a rotation angle of a liquid crystal in a part of the medium layer 6273 of the transparent part 627, to present a transparent or non-transparent state. In addition, in the present embodiment, one display unit 610 corresponds to one transparency controlling unit 620, but the disclosure is not limited thereto. In some other embodiments, one display unit may also correspond to a plurality of transparency controlling units, or a plurality of display units may correspond to a plurality of transparency controlling units.

Figure 7A:
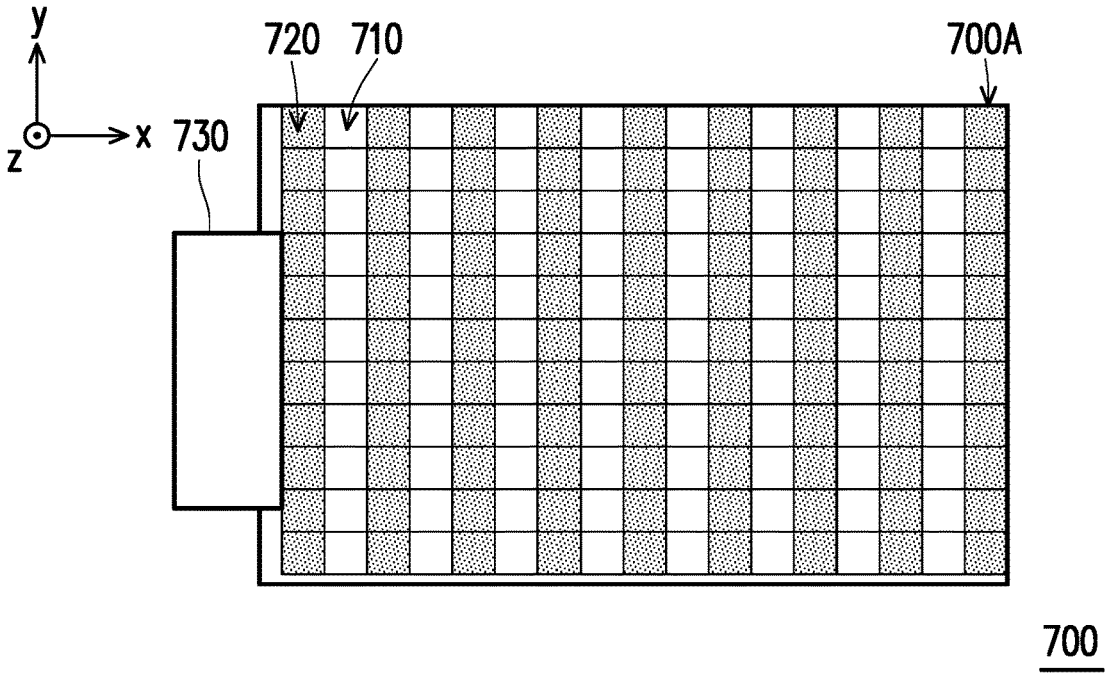
FIG. 7A is a schematic top view of a panel structure of the display device according to another embodiment of the disclosure.
Figure 7B:
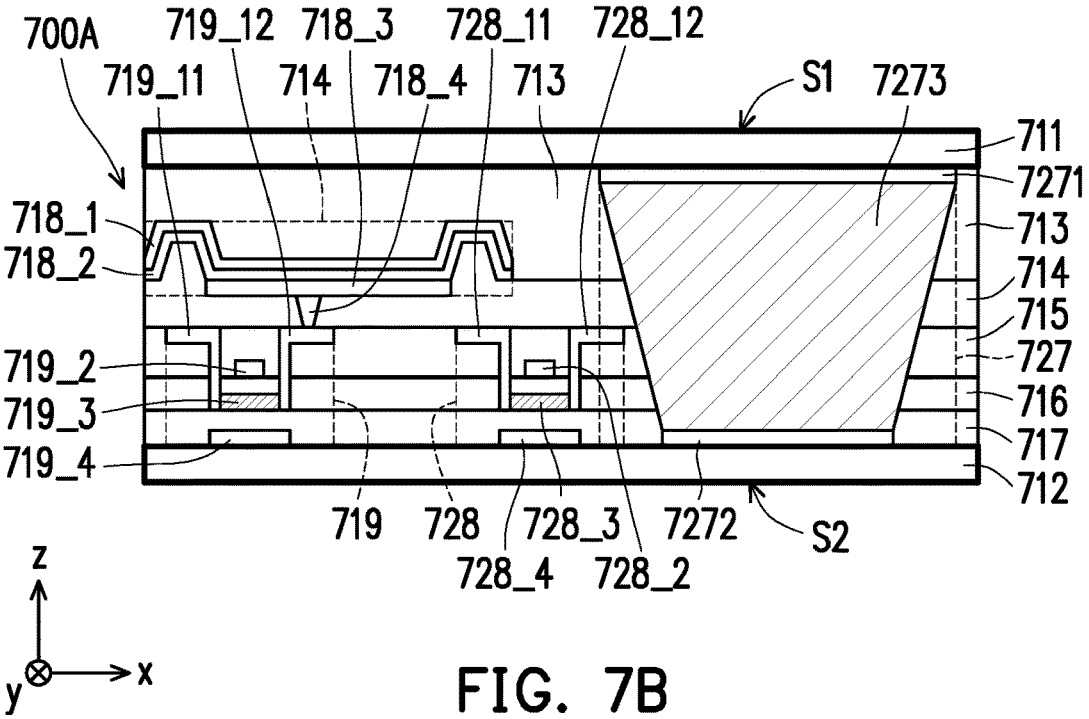
FIG. 7B is a schematic cross-sectional view of configurations of a display unit and a transparency controlling unit according to the embodiment of FIG. 7A of the disclosure.

FIG. 7A is a schematic top view of a panel structure of the display device according to another embodiment of the disclosure. FIG. 7B is a schematic cross-sectional view of a display unit and a transparency controlling unit according to the embodiment of FIG. 7A of the disclosure. Referring to FIG. 7A first, the display device 700 may be, for example, an in-cell panel structure. The display device 700 includes a mixed display panel 700A and a driving circuit 730. For example, the difference of the display device 700 from the above display device 600 lies in: The display device 700 includes a display panel 700A, and the display panel 700A includes a plurality of display units 710 arranged in an array and a plurality of transparency controlling units 720. In the present embodiment, the driving circuit 730 drives the display unit 710 and the transparency controlling unit 720 in different modes. For example, the driving circuit 730 provides two different driving signals to respectively drive the display unit 710 and the transparency controlling unit 720, to implement the display effects of the above embodiment. Specifically, the display device 700 may provide the driving signal 102 using the driving circuit 730 to control the transparency controlling unit 720, to determine a transmittance of the display device 700, namely, determine a transparent display degree of an image picture.

It should be noted that, in FIG. 7A, for the plurality of display units 710 and the plurality of transparency controlling units 720, for example, each column of the plurality of display units 710 (the plurality of display unit 710 arranged along the y direction) are disposed between the plurality of transparency controlling units 720 of two corresponding columns (the plurality of the transparency controlling units 720 are respectively arranged along the y direction), and a quantity of each column of the plurality of display units 710 is equal to a quantity of each column of the plurality of transparency controlling units 720, but the disclosure is not limited thereto. In an embodiment, for the plurality of display units 710 and the plurality of transparency controlling units 720, for example, each column of the plurality of display units 710 may also be disposed between the plurality of transparency controlling units 720 of two corresponding columns, and the quantity of each column of the plurality of display units 710 is different from the quantity of each column of the plurality of transparency controlling units 720. For example, one display unit 710 in a column is disposed between the plurality of transparency controlling units 720 of each of the two corresponding columns, or a plurality of display units 710 in a column are disposed between one transparency controlling unit 720 of each of the two corresponding columns. In another embodiment, the plurality of display units 710 and the plurality of transparency controlling units 720 may also be, for example, alternately arranged one by one. Alternatively, every neighboring four units form a pixel group, which is arranged in a manner in which three units may be the display units 710, and the other one may be the transparency controlling unit 720. For example, the three units of the first column and the second column of the first row and the first column of the second row are the display units 710, and one unit of the second column of the second row is the transparency controlling unit 720. However, an arrangement sequence, an arrangement form, and a quantity proportional relationship of units of the above display unit 710 and display unit 710 may be further correspondingly designed according to different use requirements in some embodiments of the disclosure.

Referring to FIG. 7B next, the cross-sectional structure of the display panel 700A is shown in FIG. 7B. FIG. 7B shows a schematic cross-sectional view of one transparency controlling unit corresponding to one display unit. One display unit 710 and one transparency controlling unit 720 of the display panel 700A are disposed on a lower substrate 712 and may be arranged along the x direction or the y direction. In the present embodiment, an upper substrate 711 of the display panel 700A is close to a display side S1 of the display device 700, and the lower substrate 712 of the display panel 700A is away from a display side S1 of the display device 700. In the present embodiment, an encapsulating layer 713, a planarization layer 714, a passivation layer 715, a gate insulating layer 716, and an interval layer 717 are disposed between the upper substrate 711 and the lower substrate 712 of the display panel 700A. It should be noted that, the encapsulating layer 713, the planarization layer 714, the passivation layer 715, the gate insulating layer 716, and the interval layer 717 of the present embodiment may be, for example, an insulating layer. The insulating layer may also be a single layer or another multilayer structure in some embodiments, and may include, for example, an organic material, an inorganic material, or a combination of the above, which is not limited in FIG. 7B.

In the present embodiment, the display unit 710 includes a display part 718 and a controlling transistor 719. The display part 718 of the display unit 710 is disposed between the encapsulating layer 713 and the planarization layer 714, and the controlling transistor 719 of the display unit 710 is disposed among the passivation layer 715, the gate insulating layer 716, and the interval layer 717. The display part 718 may be, for example, an OLED, and includes a part of an upper electrode 718_1, a light emitting layer 718_2, and a lower electrode 718_3. The controlling transistor 719 may be, for example, a TFT, and includes a source 719_11, a drain 719_12, a gate 719_2, a semiconductor layer 719_3, and a light shield layer 719_4. The light shield layer 719_4 may be, for example, a metal material or another light shield material. In some embodiments, the controlling transistor 719 may also not be provided with the light shield layer 719_4. The display part 718 is electrically connected to the controlling transistor 719 through a via hole 718_4. It should be noted that, the controlling transistor 719 of the present embodiment is a top gate structure, but the disclosure is not limited thereto. In an embodiment, the controlling transistor 619 may also be a bottom gate structure. In the present embodiment, the controlling transistor 719 is configured to drive the display part 718 according to a driving signal provided by the driving circuit 730. Therefore, the controlling transistor 719 may control the display part 718 to generate a display light or disable the display part 718.

In the present embodiment, a controlling transistor 728 of the transparency controlling unit 720 is disposed among the passivation layer 715, the gate insulating layer 716, and the interval layer 717, and a transparent part 727 of the transparency controlling unit 720 is disposed among the encapsulating layer 713, the planarization layer 714, the passivation layer 715, the gate insulating layer 716, and the interval layer 717. The transparent part 727 includes an electrode 7271, an electrode 7272, and a medium layer 7273. The medium layer 7273 may include, for example, a liquid crystal material, but is not limited thereto. The controlling transistor 728 may be, for example, a TFT, and includes a source 728_11, a drain 728_12, a gate 728_2, a semiconductor 728_3, and a light shield layer 728_4. In the present embodiment, the controlling transistor 728 is configured to drive a liquid crystal in the medium layer 7273 through the electrode 7271 and the electrode 7272 according to another driving signal provided by the driving circuit 730. That is, the controlling transistor 728 may control a rotation angle of the liquid crystal in the medium layer 7273 of the transparent part 727 to present a transparent or non-transparent state. It should be noted that, in the present embodiment, the drain 728_12 may be electrically connected to the electrode 7272. Although not shown in FIG. 7B, the drain 728_12 in the cross-sectional view in other regions may be connected to the electrode 7272 through a via hole, but the connecting manner is not limited thereto. In addition, in the present embodiment, one display unit 710 corresponds to one transparency controlling unit 720, but the disclosure is not limited thereto. In some other embodiments, one display unit may also correspond to a plurality of transparency controlling units, or a plurality of display units may correspond to a plurality of transparency controlling units.

Based on the above, the display device of the disclosure can provide different drive modes or driving signals to the display unit and the transparency controlling unit, so that the display device can effectively present a transparent display effect with a high contrast. Alternatively, the display device of the disclosure can provide, according to the brightness of the current ambient light, a function of automatically or manually adjusting the light intensity or the transmittance of the display light of the display device, so that the display device can present a good transparent display effect in various situations with different brightness of ambient lights. Alternatively, the display device of the disclosure can further implement a manner of a part of the display region being in the display mode, and the other part of display region being in the transparent mode, to provide a diverse transparent display effect.

It should be finally noted that the above embodiments are merely intended for describing the technical solutions of the disclosure rather than limiting the disclosure. Although the disclosure is described in detail with reference to the foregoing embodiments, those of ordinary skill in the art should understand that they can still make modifications to the technical solutions described in the foregoing embodiments or make equivalent substitutions to some technical features thereof, without departing from scope of the technical solutions of the embodiments of the disclosure.

What is claimed is:

1. A display device, comprising:

a display unit;

a transparency controlling unit; and a driving circuit, coupled to the display unit and the transparency controlling unit, wherein the driving circuit drives the display unit and the transparency controlling unit in different modes, wherein the driving circuit adjusts at least one of a first driving signal for driving the display unit and a second driving signal for driving the transparency controlling unit according to a light intensity of a transmitted light of the display device and a light intensity of a display light of the display device.

2. The display device according to claim 1, wherein the display unit and the transparency controlling unit are driven in different refresh rates.

3. The display device according to claim 2, wherein the display unit is driven in a higher refresh rate than the transparency controlling unit.

4. The display device according to claim 1, wherein the display unit is driven in a first number of gray levels and the transparency controlling unit is driven in a second number of gray levels, and the first number of gray levels is different from the second number of gray levels.

5. The display device according to claim 4, wherein the first number of gray levels is greater than the second number of gray levels.

6. The display device according to claim 1, wherein the display unit is driven in a current mode and the transparency controlling unit is driven in a voltage mode.

7. The display device according to claim 1, wherein the light intensity of the transmitted light of the display device divided by the light intensity of the display light is less than 1 in a display mode.

8. The display device according to claim 1, wherein the light intensity of the transmitted light of the display device divided by the light intensity of the display light is less than 0.5 in a display mode.

9. The display device according to claim 1, wherein the light intensity of the transmitted light of the display device divided by the light intensity of the display light is greater than 1 in a transparent mode.

10. The display device according to claim 1, wherein the light intensity of the transmitted light of the display device divided by the light intensity of the display light is greater than 2 in a transparent mode.

* * * * *